US010441090B2

(12) United States Patent
Lehan

(10) Patent No.: US 10,441,090 B2
(45) Date of Patent: Oct. 15, 2019

(54) CHILD CARRIER HAVING ADJUSTABLE SEAT COUPLING

(71) Applicant: LILLEbaby, LLC, Boulder, CO (US)

(72) Inventor: Lisbeth Hals Lehan, Niwot, CO (US)

(73) Assignee: LILLEbaby, LLC, Boulder, CO (US)

( * ) Notice: Subject to any disclaimer, the term of this patent is extended or adjusted under 35 U.S.C. 154(b) by 0 days.

(21) Appl. No.: 15/537,171

(22) PCT Filed: Jan. 17, 2015

(86) PCT No.: PCT/US2015/011880
§ 371 (c)(1),
(2) Date: Jun. 16, 2017

(87) PCT Pub. No.: WO2016/114801
PCT Pub. Date: Jul. 21, 2016

(65) Prior Publication Data

US 2018/0000258 A1 Jan. 4, 2018

Related U.S. Application Data

(63) Continuation of application No. 14/597,246, filed on Jan. 15, 2015, now Pat. No. 9,314,113.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
(Continued)

(56) References Cited

U.S. PATENT DOCUMENTS 2,550,851 A 5/1951 Nichols
2,599,474 A 6/1952 Mills
(Continued)

FOREIGN PATENT DOCUMENTS

AT 11620 U2 2/2011
AU 7440987 A 12/1988
(Continued)

OTHER PUBLICATIONS

Korean Patent Application No. 10-2018-7008094, English translation of Office Action dated Mar. 21, 2018, 10 pages.
(Continued)

*Primary Examiner* — Adam J Waggenspack
(74) *Attorney, Agent, or Firm* — Lathrop Gage LLP

(57) ABSTRACT

A carrier [100] for transporting a child [105] by a transporting individual [140]. The carrier [100] includes a belt [120], a seat [110], a torso support [115], and one or more couplers [125]. The belt [120] is configured for securing about the waste and/or hips of the transporting individual [140]; the seat [110] is coupled to the belt [120], is configured for at least partially supporting the child [105] if the child [105] is seated in the carrier [100], and has a surface [130] configured for at least partially supporting at least part of the posterior of the child [105]; the torso support [115] is coupled to the seat [110] by one or more couplers [125] and is configured for supporting at least part of the torso of the child [105]; and the one or more couplers [125] are configured to enable adjustment of a distance [220] between one or more coupling locations [210] for each of the one or more couplers [125] and a selected reference point [200].

17 Claims, 16 Drawing Sheets

(58) Field of Classification Search
USPC ..... 224/158–161, 632
See application file for complete search history.

(56) References Cited

U.S. PATENT DOCUMENTS

| | | | | |
|---|---|---|---|---|
| 3,027,058 | A | 3/1962 | Huber | |
| 3,229,873 | A | 1/1966 | Hershman | |
| 3,575,326 | A | 4/1971 | Chappell | |
| 3,780,919 | A | 12/1973 | Hansson | |
| 3,871,562 | A | 3/1975 | Grenier | |
| 4,009,808 | A * | 3/1977 | Sharp | A47D 13/025 224/160 |
| 4,081,117 | A | 3/1978 | Crane | |
| 4,234,229 | A | 11/1980 | Arnold | |
| 4,271,998 | A | 6/1981 | Ruggiano | |
| 4,333,591 | A | 6/1982 | Case | |
| 4,402,440 | A | 9/1983 | Purtzer | |
| 4,428,514 | A | 1/1984 | Elf | |
| 4,434,920 | A | 3/1984 | Moore | |
| 4,467,945 | A | 8/1984 | Schaapveld | |
| 4,492,326 | A | 1/1985 | Storm | |
| 4,538,737 | A * | 9/1985 | Delaney | B60P 7/0892 206/560 |
| 4,724,988 | A | 2/1988 | Tucker | |
| 4,746,044 | A | 5/1988 | Arvizu et al. | |
| 4,986,458 | A | 1/1991 | Linday | |
| 5,020,709 | A | 6/1991 | Hoaglan | |
| 5,125,718 | A | 6/1992 | Czernakowski et al. | |
| 5,195,666 | A * | 3/1993 | Yamaguchi | A45F 3/02 224/159 |
| 5,205,450 | A | 4/1993 | Derosier | |
| 5,205,451 | A | 4/1993 | Manzer | |
| 5,224,637 | A * | 7/1993 | Colombo | A47D 13/025 224/158 |
| 5,246,152 | A | 9/1993 | Dotseth | |
| 5,361,952 | A | 11/1994 | Gold | |
| 5,490,620 | A | 2/1996 | Bergkvist | |
| 5,522,528 | A | 6/1996 | Petricola | |
| 5,662,339 | A | 9/1997 | Svendsen et al. | |
| 5,678,739 | A | 10/1997 | Darling et al. | |
| 5,692,655 | A | 12/1997 | Fair et al. | |
| 5,711,466 | A * | 1/1998 | Kataoka | A47D 13/025 224/159 |
| 5,732,861 | A | 3/1998 | Jakobson | |
| 5,813,580 | A | 9/1998 | Fair | |
| 5,848,741 | A | 12/1998 | Fair | |
| 5,927,576 | A | 7/1999 | Nielsen | |
| 6,045,018 | A | 4/2000 | Onishi | |
| 6,158,641 | A | 12/2000 | Eyman et al. | |
| 6,325,259 | B1 * | 12/2001 | Tharalson | A47D 13/025 224/159 |
| D452,993 | S | 1/2002 | Norman | |
| D453,066 | S | 1/2002 | Norman | |
| D455,546 | S | 4/2002 | Norman | |
| 6,415,969 | B1 | 7/2002 | Higuchi | |
| 6,443,339 | B1 | 9/2002 | Higuchi | |
| 6,598,771 | B2 | 7/2003 | Norman | |
| 6,672,493 | B1 | 1/2004 | Fair et al. | |
| 6,736,299 | B2 | 5/2004 | Bergkvist | |
| D507,102 | S | 7/2005 | Bergkvist et al. | |
| 7,070,076 | B2 | 7/2006 | Bergkvist | |
| 7,284,503 | B2 | 10/2007 | Elmberg | |
| 7,322,498 | B2 | 1/2008 | Frost | |
| 7,343,880 | B2 | 3/2008 | Bergkvist | |
| D567,499 | S | 4/2008 | Elmberg et al. | |
| 7,637,404 | B1 * | 12/2009 | Stepanova | B60R 7/085 224/275 |
| D623,401 | S | 9/2010 | Bergkvist et al. | |
| D623,402 | S | 9/2010 | Bergkvist et al. | |
| 8,225,972 | B2 * | 7/2012 | Butkiewicz | B62J 1/14 224/413 |
| 8,453,894 | B2 * | 6/2013 | Jung | A47D 13/025 224/159 |
| 8,844,778 | B2 * | 9/2014 | St. Georges | B62J 9/00 224/407 |
| 2001/0030210 | A1 | 10/2001 | Donine | |
| 2002/0011503 | A1 | 1/2002 | Hwang | |
| 2002/0078494 | A1 | 6/2002 | Hunter | |
| 2002/0130148 | A1 | 9/2002 | Gal | |
| 2003/0178452 | A1 | 9/2003 | Norman | |
| 2004/0045073 | A1 | 3/2004 | Marquez et al. | |
| 2004/0061361 | A1 | 4/2004 | Jefferson et al. | |
| 2004/0155078 | A1 | 8/2004 | Hwang et al. | |
| 2005/0045674 | A1 | 3/2005 | Rehbein | |
| 2005/0076856 | A1 | 4/2005 | Bruck et al. | |
| 2005/0155995 | A1 | 7/2005 | Lee | |
| 2005/0155996 | A1 | 7/2005 | Hiscocks | |
| 2005/0173479 | A1 | 8/2005 | Gentil | |
| 2005/0184114 | A1 | 8/2005 | Hoff et al. | |
| 2005/0189386 | A1 | 9/2005 | Mortell | |
| 2005/0205620 | A1 | 9/2005 | Yagisawa | |
| 2005/0218168 | A1 | 10/2005 | Chua | |
| 2005/0242136 | A1 | 11/2005 | Moriguchi et al. | |
| 2006/0130220 | A1 | 6/2006 | Morgan et al. | |
| 2007/0138218 | A1 | 6/2007 | Calilung et al. | |
| 2007/0241146 | A1 | 10/2007 | Nyberg et al. | |
| 2007/0241147 | A1 | 10/2007 | Nyberg et al. | |
| 2007/0246493 | A1 * | 10/2007 | Kernkamp | A45F 3/14 224/159 |
| 2007/0283480 | A1 | 12/2007 | Harris | |
| 2007/0284403 | A1 | 12/2007 | Minami et al. | |
| 2008/0073391 | A1 | 3/2008 | Frost | |
| 2008/0087694 | A1 | 4/2008 | Meng et al. | |
| 2008/0283559 | A1 | 11/2008 | Parness et al. | |
| 2008/0314940 | A1 | 12/2008 | Cohen et al. | |
| 2009/0019621 | A1 | 1/2009 | Radcliffe et al. | |
| 2009/0114691 | A1 | 5/2009 | Bizzell | |
| 2010/0065594 | A1 | 3/2010 | Liljedahl et al. | |
| 2012/0043359 | A1 | 2/2012 | Bergkvist et al. | |
| 2012/0298702 | A1 | 11/2012 | Jung et al. | |

FOREIGN PATENT DOCUMENTS

| | | | |
|---|---|---|---|
| AU | 634050 | B2 | 2/1993 |
| CA | 2141121 | A1 | 7/1996 |
| CA | 2119854 | C | 3/2006 |
| CN | 2364735 | Y | 2/2000 |
| CN | 2443669 | Y | 8/2001 |
| CN | 2459991 | Y | 11/2001 |
| CN | 2548492 | Y | 5/2003 |
| CN | 2559278 | Y | 7/2003 |
| CN | 1549684 | A | 11/2004 |
| CN | 2674963 | Y | 2/2005 |
| CN | 2730710 | Y | 10/2005 |
| CN | 1692862 | A | 11/2005 |
| CN | 2920042 | Y | 7/2007 |
| DE | 20000361 | U1 | 10/2000 |
| EP | 508641 | A1 | 10/1992 |
| EP | 611234 | A1 | 8/1994 |
| EP | 662292 | A1 | 7/1995 |
| EP | 1099619 | A2 | 5/2001 |
| EP | 1665959 | A1 | 6/2006 |
| EP | 1765123 | A2 | 3/2007 |
| EP | 1767125 | A1 | 3/2007 |
| EP | 1804620 | A1 | 7/2007 |
| EP | 1992257 | A1 | 11/2008 |
| FI | 882539 | | 5/1988 |
| FR | 2434600 | A3 | 3/1980 |
| FR | 2556574 | A1 | 6/1985 |
| FR | 2585940 | A1 | 2/1987 |
| FR | 2666213 | B1 | 12/1992 |
| FR | 2798830 | A1 | 3/2001 |
| FR | 2802398 | A3 | 6/2001 |
| FR | 2794010 | B1 | 7/2001 |
| FR | 2806278 | A1 | 9/2001 |
| FR | 2851436 | A1 | 8/2004 |
| FR | 2859084 | A1 | 3/2005 |
| FR | 2892610 | A1 | 5/2007 |
| GB | 678225 | A | 8/1952 |
| GB | 907687 | A | 10/1962 |
| GB | 1121546 | A | 7/1968 |
| GB | 2026848 | A | 2/1980 |
| GB | 2084861 | A | 4/1982 |
| GB | 2224635 | B | 2/1993 |

(56) References Cited

FOREIGN PATENT DOCUMENTS

| | | | |
|---|---|---|---|
| GB | 2346314 | A | 8/2000 |
| GB | 2355913 | A | 5/2001 |
| JP | 03221007 | A | 9/1991 |
| JP | 06253959 | A | 9/1994 |
| JP | 07016627 | U | 3/1995 |
| JP | 07-213388 | | 8/1995 |
| JP | 09-135752 | | 5/1997 |
| JP | 09121987 | A | 5/1997 |
| JP | 10108764 | A | 4/1998 |
| JP | 10117896 | A | 5/1998 |
| JP | 10234531 | A | 9/1998 |
| JP | 09082722 | A | 10/1998 |
| JP | 10276869 | A | 10/1998 |
| JP | 11276311 | A | 10/1999 |
| JP | 00-023801 | | 1/2000 |
| JP | 2000041796 | A | 2/2000 |
| JP | 2000296033 | A | 10/2000 |
| JP | 2000296034 | A | 10/2000 |
| JP | 2001078857 | A | 3/2001 |
| JP | 2001137082 | A | 5/2001 |
| JP | 02-223837 | | 8/2002 |
| JP | 2002253394 | A | 9/2002 |
| JP | 2002339112 | A | 11/2002 |
| JP | 2003000401 | A | 1/2003 |
| JP | 2003010010 | A | 1/2003 |
| JP | 3491801 | B2 | 1/2004 |
| JP | 3491802 | B2 | 1/2004 |
| JP | 2004011046 | A | 1/2004 |
| JP | 2004141573 | A | 5/2004 |
| JP | 2004358005 | A | 12/2004 |
| JP | 2005021529 | A | 1/2005 |
| JP | 2005131146 | A | 5/2005 |
| JP | 3669612 | B2 | 7/2005 |
| JP | 2005185426 | A | 7/2005 |
| JP | 2005193025 | A | 7/2005 |
| JP | 3114676 | U9 | 8/2005 |
| JP | 2005312759 | A | 11/2005 |
| JP | 2006075441 | A | 3/2006 |
| JP | 2006141680 | A | 6/2006 |
| JP | 2006230640 | A | 9/2006 |
| JP | 2006296897 | A | 11/2006 |
| JP | 2007268077 | A | 10/2007 |
| JP | 2008516725 | T | 5/2008 |
| KR | 900011032 | Y1 | 12/1990 |
| KR | 920007494 | Y1 | 10/1992 |
| KR | 101219312 | B1 | 6/1998 |
| KR | 19980071399 | A | 10/1998 |
| KR | 200212061 | Y1 | 11/2000 |
| KR | 200222642 | Y1 | 2/2001 |
| KR | 200222670 | Y1 | 2/2001 |
| KR | 1020020008534 | A | 1/2002 |
| KR | 100327849 | B1 | 3/2002 |
| KR | 200281097 | Y1 | 6/2002 |
| KR | 200286208 | Y1 | 8/2002 |
| KR | 200291528 | Y1 | 9/2002 |
| KR | 200291529 | Y1 | 9/2002 |
| KR | 200296329 | Y1 | 11/2002 |
| KR | 200297777 | Y1 | 11/2002 |
| KR | 1020020094618 | A | 12/2002 |
| KR | 200306315 | Y1 | 2/2003 |
| KR | 200312695 | Y1 | 4/2003 |
| KR | 1020030030829 | A | 4/2003 |
| KR | 200315820 | Y1 | 5/2003 |
| KR | 200315912 | Y1 | 5/2003 |
| KR | 100386650 | B1 | 6/2003 |
| KR | 100386652 | B1 | 6/2003 |
| KR | 200324019 | Y1 | 8/2003 |
| KR | 200324020 | Y1 | 8/2003 |
| KR | 200332214 | Y1 | 10/2003 |
| KR | 200333788 | Y1 | 11/2003 |
| KR | 1020040009996 | A | 1/2004 |
| KR | 1020040019815 | A | 3/2004 |
| KR | 1020040020319 | A | 3/2004 |
| KR | 200348986 | Y1 | 4/2004 |
| KR | 200351022 | Y1 | 5/2004 |
| KR | 200353288 | Y1 | 6/2004 |
| KR | 200353481 | Y1 | 6/2004 |
| KR | 1020040064749 | A | 7/2004 |
| KR | 200360231 | Y1 | 8/2004 |
| KR | 1020040078330 | A | 9/2004 |
| KR | 200373775 | Y1 | 1/2005 |
| KR | 100494057 | B1 | 6/2005 |
| KR | 200414819 | Y1 | 4/2006 |
| KR | 1020070033250 | A | 3/2007 |
| KR | 1020070033251 | A | 3/2007 |
| KR | 1020070083354 | A | 8/2007 |
| KR | 100763412 | B1 | 10/2007 |
| KR | 1020080052814 | A | 6/2008 |
| KR | 1020080052816 | A | 6/2008 |
| KR | 200459659 | Y1 | 4/2012 |
| KR | 101359888 | B1 | 2/2014 |
| KR | 30-2013-0057074 | | 3/2014 |
| KR | 30-2013-0057077 | | 3/2014 |
| KR | 30-2013-0066606 | | 3/2014 |
| KR | 10-2014-0070778 | | 6/2014 |
| KR | 20-2014-0001249 | | 3/2015 |
| KR | 30-2015-0001275 | | 12/2015 |
| KR | 20-2016-0002831 | | 12/2016 |
| NO | 20065335 | B | 9/2007 |
| RU | 2161010 | C1 | 12/2000 |
| TW | 494726 | B | 7/2002 |
| TW | 572593 | B | 1/2004 |
| TW | D100505 | S | 10/2004 |
| TW | M261126 | U | 4/2005 |
| TW | D106359 | S | 9/2005 |
| TW | M320338 | U | 10/2007 |
| WO | WO8404445 | A1 | 11/1984 |
| WO | WO9509553 | A1 | 4/1995 |
| WO | WO2004006729 | A1 | 1/2004 |
| WO | WO2005020763 | A2 | 3/2005 |
| WO | WO2005099521 | A1 | 10/2005 |
| WO | WO2006025126 | A1 | 3/2006 |
| WO | WO2005072366 | A3 | 10/2006 |
| WO | WO2006116117 | A2 | 11/2006 |
| WO | WO2007000762 | A2 | 1/2007 |
| WO | WO2007145832 | A2 | 12/2007 |
| WO | WO2007146866 | A2 | 12/2007 |
| WO | WO2008041913 | A1 | 4/2008 |

OTHER PUBLICATIONS

Written Opinion of Singaporean Patent Application No. 11201705794R dated Apr. 20, 2018, 5 pp.

European Patent Application No. 15878238.3, Extended Search and Opinion dated Jun. 28, 2018, 8 pages.

International Search Report and Written Opinion for PCT/US2015/011880 dated Sep. 18, 2015, 9 pages.

Japanese Patent Application No. 2017-556509, English translation of Office Action dated Feb. 8, 2019, 5 pages.

* cited by examiner

CHILD CARRIER HAVING ADJUSTABLE SEAT COUPLING

BACKGROUND

A number of carriers have been and are currently available for transporting a child by a parent or other individual. The carriers are designed for various carrying modes, i.e., on the back, the front, or the hip of the carrying individual as well as with the child facing toward or away from the carrying individual. They are also designed for various ages, weights, and sizes of the child to be carried in the carrier. The carriers available range from soft, light-weight carriers that snuggle the child close to the carrying individual to larger carriers having metal frames intended for carrying the child on the carrying individual's back.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. In these drawings, like reference numerals identify corresponding elements.

DETAILED DESCRIPTION

Figure 1A:
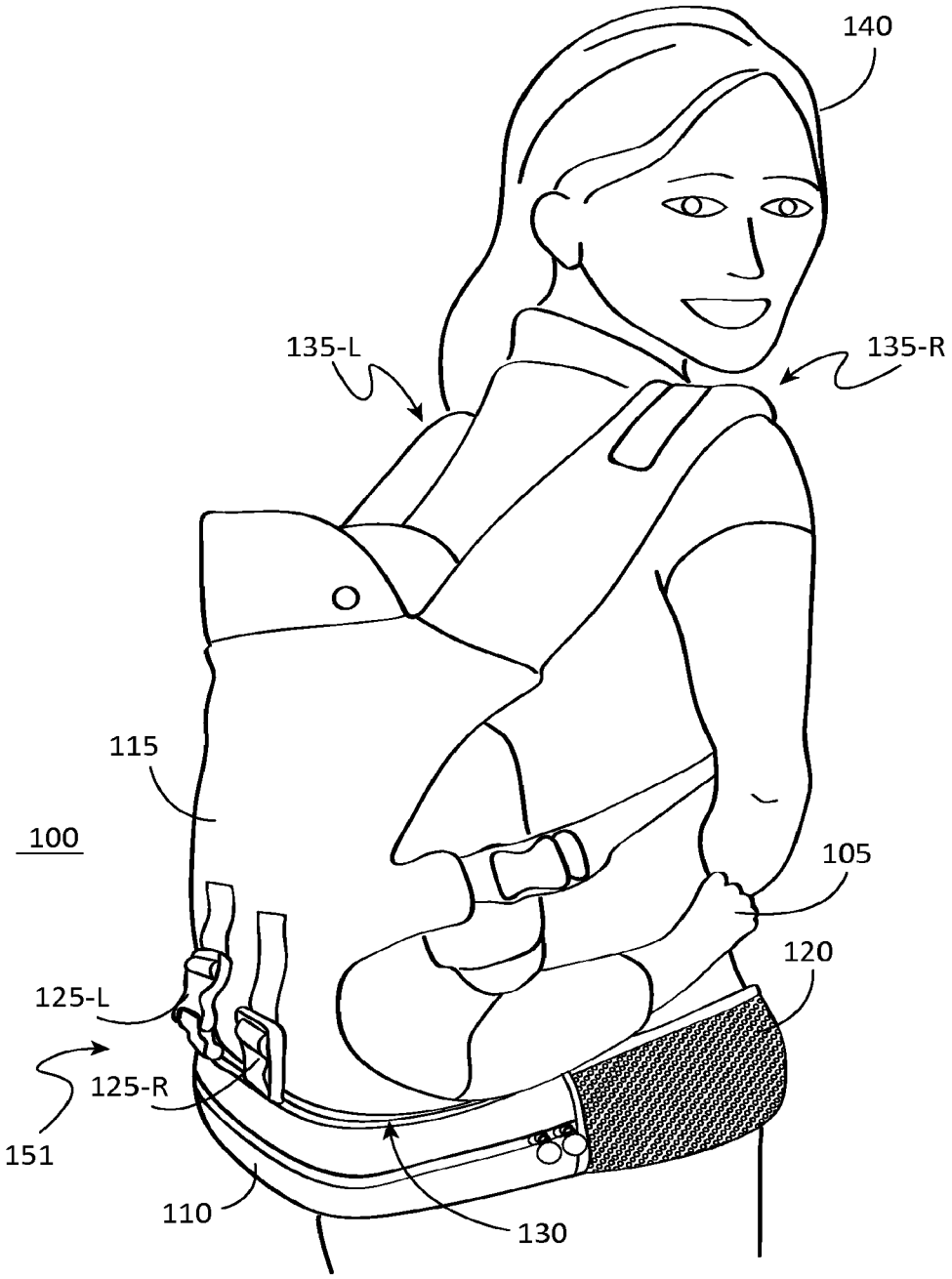
FIG. 1A is a drawing of a child carrier with a child seated in the carrier as described in various representative embodiments.

As shown in the drawings for purposes of illustration, novel child carriers are disclosed herein that enable carrying the child in adjustable seating positions. At any given age there is variability in the size of children, and as a child ages he or she naturally becomes larger. In representative embodiments disclosed herein the depth of the seat available for supporting the child is adjustable. The available seat space can be adjusted to the size of the child so that the child does not sit loose in the carrier thereby enhancing the safety and comfort of the child while in the child carrier. The depth of seat available for supporting the child can be changed at selected fixed or partially fixed locations or by continuous adjustment within a selected range. Previous child carriers have not had the flexibility of adjusting the depth of the seat available for the child to sit on.

In the following detailed description and in the several figures of the drawings, like elements are identified with like reference numerals.

FIG. 1A is a drawing of a child carrier 100 with a child 105 seated in the carrier 100 as described in various representative embodiments. In the representative embodiment of FIG. 1A, the carrier 100 comprises a belt 120, a seat 110, a torso support 115, and one or more couplers 125. A left coupler 125-L and a right coupler 125-R shown in FIG. 1A are referred to collectively as the coupler 125 or the couplers 125. However, the one or more couplers 125 are not restricted to being two couplers 125 but may be any appropriate number of parts. Also shown in FIG. 1A is a shoulder strap 135 configured for providing additional support to the child 105 and the carrier 100 when coupled to a transporting individual 140. In this representative embodiment the shoulder strap 135 comprises a right shoulder strap 135-R and a left shoulder strap 135-L each of which could comprise one or more smaller straps and/or other elements, as well as coupling devices configured for coupling to the torso support 115 and/or to the seat 110 and/or the belt 120 as well as to each other or to each other via a connecting coupling. The left and right shoulder straps 135-L,135-R could also comprise one or more removable and/or non-removable shoulder pads and are referred to collectively as the shoulder strap 135. The carrier 100 with the child 105 seated in it as shown in FIG. 1A is situated for carrying by the transporting individual 140. With the child 105 seated in the carrier 100, at least part of the posterior of the child 105 is at least partially supported on a surface 130 of the seat 110. The surface 130 is shown more clearly in FIG. 1B. The belt 120 is configured for securing about the hips and/or waist of the transporting individual 140 and for supporting at least part of the weight of the child 105. If configured for securing about at least part of the hips of the transporting individual 140 and for supporting at least part of the weight of the child 105 thereon, the belt 120 can be a hip belt 120 and referred to as such. In FIG. 1A the seat 110 is coupled to the belt 120 and is configured for at least partially supporting the child 105 when seated in the carrier 100. The torso support 115 is coupled to the seat 110 in a coupling position 150 which as is shown in FIG. 1A is referred to as a first coupling position 151 by the one or more couplers 125 and is configured for supporting at least part of the torso of the child 105.

For ease and clarity of discussion, the term "left" as used herein refers to a component of the carrier 100 located on the left side of an associated component as viewed looking toward the belt 120 from that part of the seat 110 furthest away from the belt 120, and similarly the term "right" as used herein refers to a component of the carrier 100 located on the right side of an associated component as viewed looking toward the belt 120 from that part of the seat 110 furthest away from the belt 120. Specifically this identification refers herein to the left coupler 125-L, the right coupler 125-R, the right shoulder strap 135-R, and the left shoulder strap 135-L. However, as noted above this identification is for ease and clarity of discussion and does not limit any of these or other components disclosed herein from being on the left or on the right side of the carrier 100.

Figure 1B:
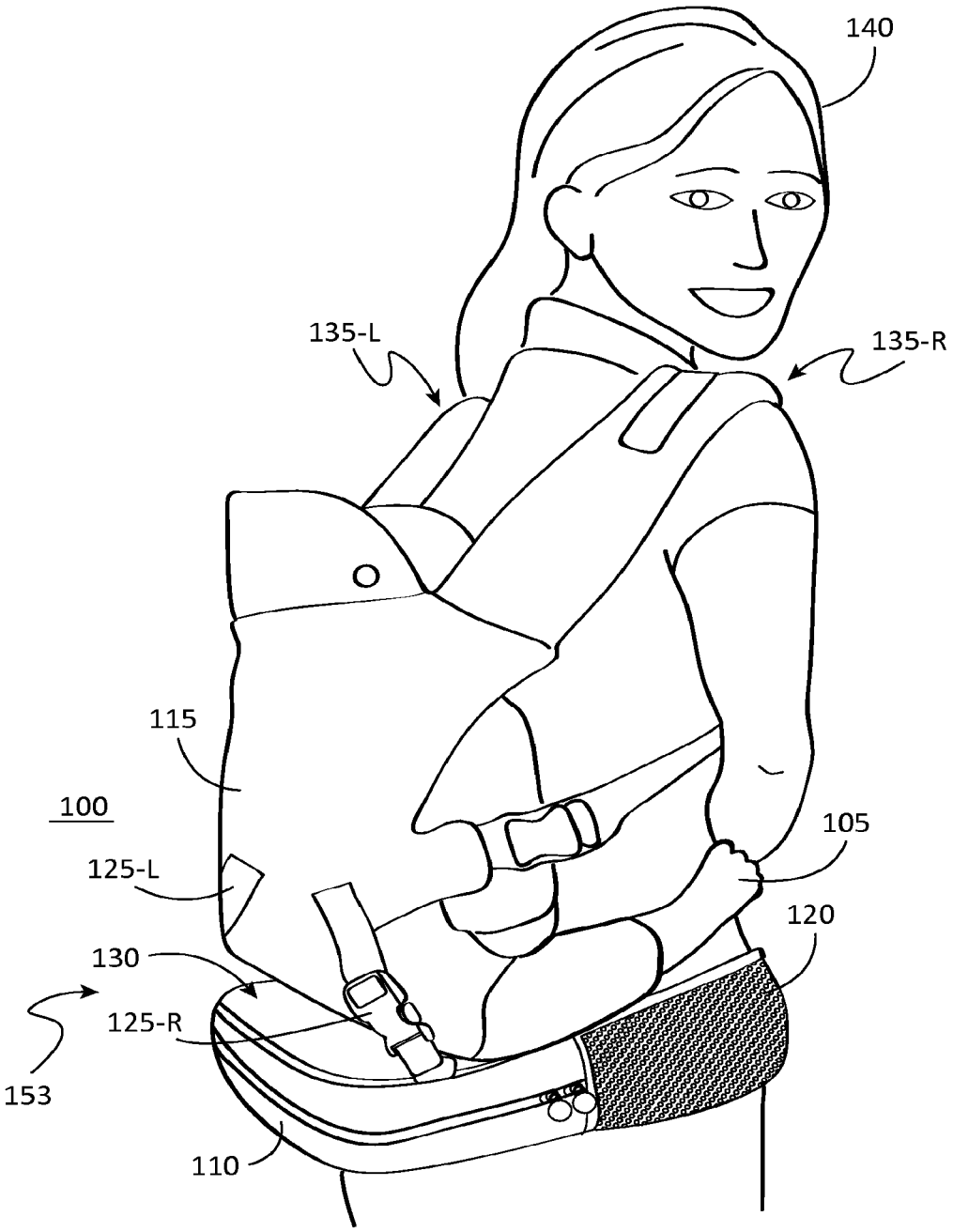
FIG. 1B is a drawing of the child carrier of FIG. 1A with the coupling of the torso support to the seat at a third coupling position.

FIG. 1B is a drawing of the child carrier 100 of FIG. 1A with the coupling of the torso support 115 to the seat 110 at a third coupling position 153. The coupling position 150 shown in FIG. 1B is referred to herein as the third coupling position 153. With the carrier 100 in the third coupling position 153 of FIG. 1B, the couplers 125 attach the torso support 115 to the seat 110 at locations on the seat 110 closer to the seat belt 120 than in the first coupling position 151 of FIG. 1A. Thus, the child 105 is placed closer to the seat belt 120 and thereby to the transporting individual 140 than the child 105 would be in the first coupling position 151. Only a portion of the left coupler 125-L is shown in FIG. 1B. A second coupling position 152 intermediate between the first coupling position 151 and the third coupling position 153 is disclosed in and described with FIGS. 2B and 3B. As previously indicated the surface 130 which is the top surface 130 of the seat 110 is shown more clearly in FIG. 1B than in FIG. 1A.

Figure 1C:
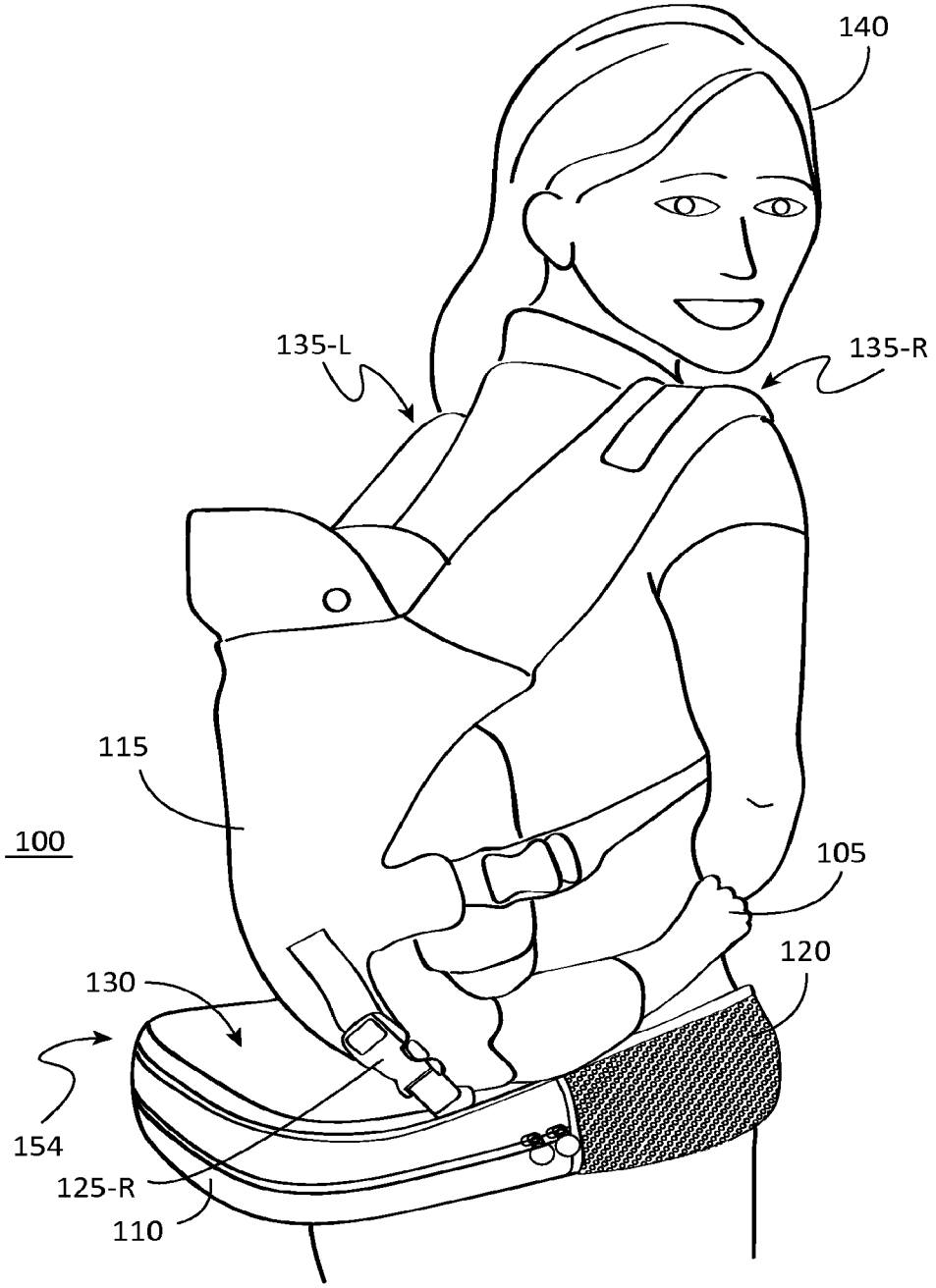
FIG. 1C is a drawing of the child carrier of FIG. 1A with the coupling of the torso support to the seat at a fourth coupling position.

FIG. 1C is a drawing of the child carrier 100 of FIG. 1A with the coupling of the torso support 115 to the seat 110 at a fourth coupling position 154. The coupling position 150 shown in FIG. 1C is referred to herein as the fourth coupling position 154. With the carrier 100 in the fourth coupling position 154 of FIG. 1C, the couplers 125 attach the torso support 115 to the seat 110 at locations on the seat 110 closer to the seat belt 120 than in both the first and third coupling positions 151,153 of associated FIGS. 1A and 1B as well as in the second coupling position 152 of FIGS. 2B and 3B. Thus, the child 105 is placed closer to the seat belt 120 and thereby to the transporting individual 140 than the child 105 would be in the first, second and third coupling positions 151,152,153. In FIG. 1C the torso support 115 is in front of the left coupler 125-L resulting in the left coupler 125-L not being shown in FIG. 1C.

Figure 1D:
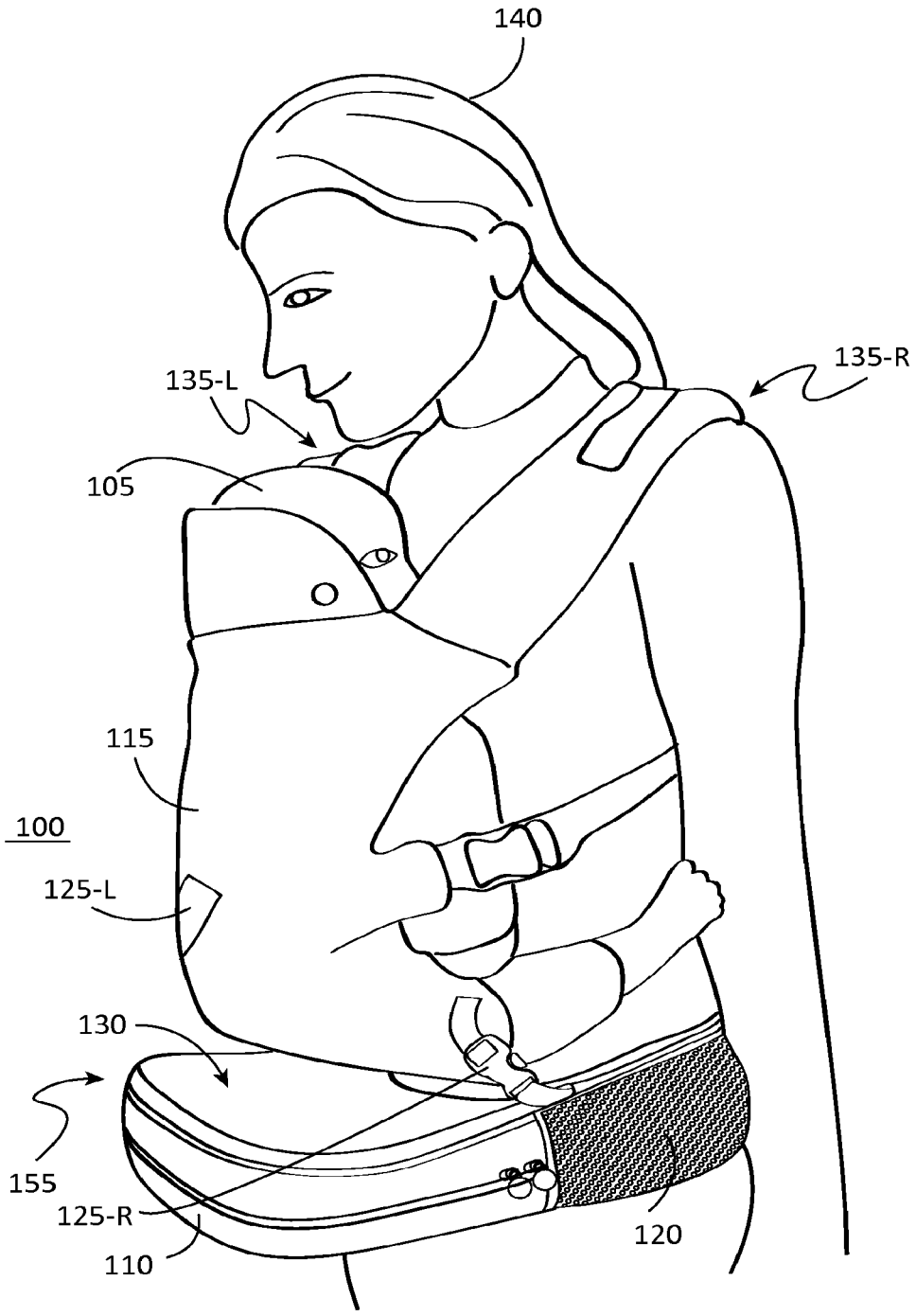
FIG. 1D is a drawing of the child carrier of FIG. 1A with the coupling of the torso support to the seat at a fifth coupling position.

FIG. 1D is a drawing of the child carrier 100 of FIG. 1A with the coupling of the torso support 115 to the seat 110 at a fifth coupling position 155. The coupling position 150 shown in FIG. 1D is referred to herein as the fifth coupling position 155. With the carrier 100 in the fifth coupling position 155 of FIG. 1D, the couplers 125 attach the torso support 115 to the seat 110 at locations on the seat 110 closer to the seat belt 120 than in the first, third and fourth coupling positions 151,153,154 of associated FIGS. 1A, 1B and 1C and in the second coupling position 152 of FIGS. 2B and 3B. Thus, the child 105 is placed closer to the seat belt 120 and thereby to the transporting individual 140 than the child 105 would be in the first, second, third and fourth coupling positions 151,152,153,154. In FIG. 1D the torso support 115 is in front of the left coupler 125-L resulting in the left coupler 125-L not being shown in FIG. 1D. In the representative embodiment of the fifth coupling position 155 shown in FIG. 1D, the couplers 125 are placed at or near sites at which the seat 110 is coupled to the belt 120 which attachment could be to the seat 110 and/or to the belt 120. In this configuration, the posterior of the child 105 is not supported by the seat 110 but is supported by the torso support 115.

Note in FIGS. 1A-1C, the carrier 100 is on the back of the transporting individual 140 with the child 105 facing toward the transporting individual 140, and in FIG. 1D the carrier 100 is on the front of the transporting individual 140 with the child 105 facing toward the transporting individual 140. However, in addition to other configurations the carrier 100 could be located either on the front of or on the back of the transporting individual 140 with the child 105 facing either toward or away from the transporting individual 140.

Figure 2A:
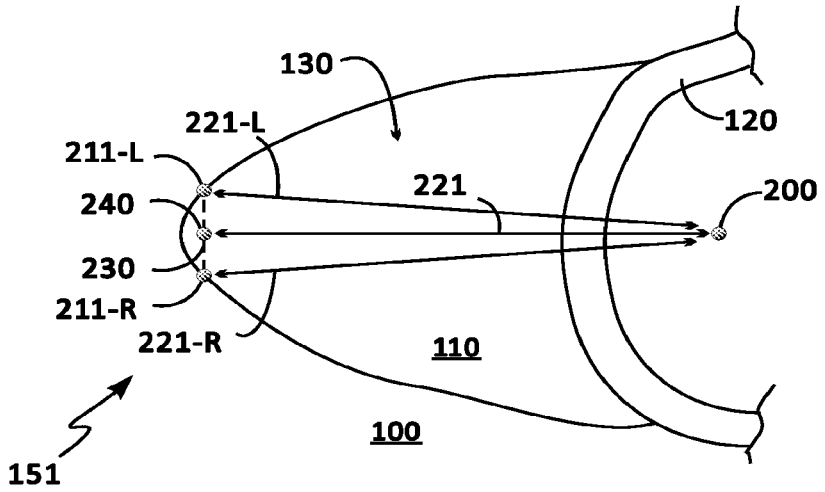
FIG. 2A is a drawing of an outline of a seat and part of a belt of the child carrier in the first coupling position of FIG. 1A.

FIG. 2A is a drawing of an outline of the seat 110 and part of the belt 120 of the child carrier 100 in the first coupling position 151 of FIG. 1A. Corresponding to FIG. 1A, in FIG. 2A the left coupler 125-L, which is not shown in FIG. 2A, is located on the seat 110 at a first left coupling location 211-L which is at a first left distance 221-L from a selected reference point 200, and the right coupler 125-R, which is also not shown in FIG. 2A, is located on the seat 110 at a first right coupling location 211-R which is at a first right distance 221-R from the reference point 200. The reference point 200 shown on the figures is selected for ease and clarity of discussion. Collectively the first left coupling location 211-L and the first right coupling location 211-R are referred to herein as the first coupling location 211. The first coupling location 211 is not shown in the drawings but could be represented by an appropriate point 240 on FIG. 2A. Also collectively the first left distance 221-L and the first right distance 221-R are referred to herein and shown as a representative first distance 221. The first distance 221 could be measured, for example, from the point 240 located on a line segment 230 between the first left coupling location 211-L and the first right coupling location 211-R, which could be, for example, the mid-point of that line segment 230, to the reference point 200.

Figure 2B:
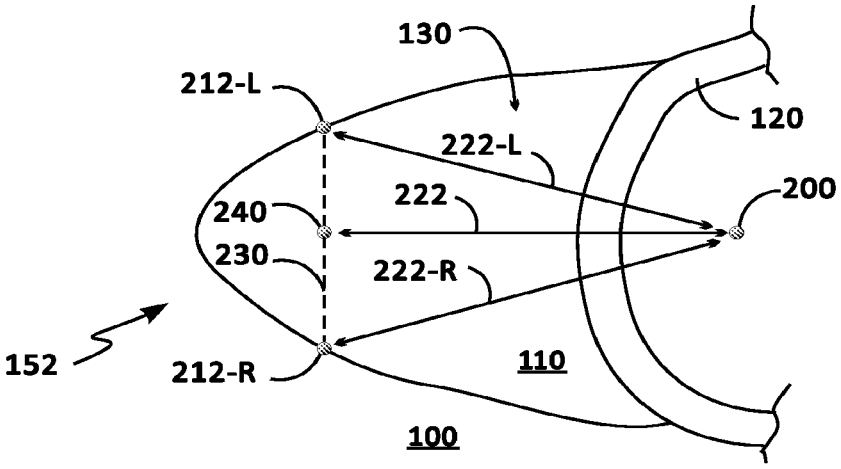
FIG. 2B is a drawing of the outline of the seat and part of the belt of the child carrier in the second coupling position intermediate to that of FIGS. 1A and 1B.

FIG. 2B is a drawing of the outline of the seat 110 and part of the belt 120 of the carrier 100 in the second coupling position 152 intermediate to that of FIGS. 1A and 1B. In FIG. 2B the left coupler 125-L, which is not shown in FIG. 2B, is located on the seat 110 at a second left coupling location 212-L which is at a second left distance 222-L from the reference point 200, and the right coupler 125-R, which is also not shown in FIG. 2B, is located on the seat 110 at a second right coupling location 212-R which is at a second right distance 222-R from the reference point 200. Collectively the second left coupling location 212-L and the second right coupling location 212-R are referred to herein as the second coupling location 212. The second coupling location 212 is not shown in the drawings but could be represented by the point 240 on FIG. 2B. Also collectively the second left distance 222-L and the second right distance 222-R are referred to herein and shown as a representative second distance 222. The second distance 222 could be measured, for example, from the point 240 located on the line segment 230 between the second left coupling location 212-L and the second right coupling location 212-R, which could be, for example, the mid-point of that line segment 230, to the reference point 200.

Figure 2C:
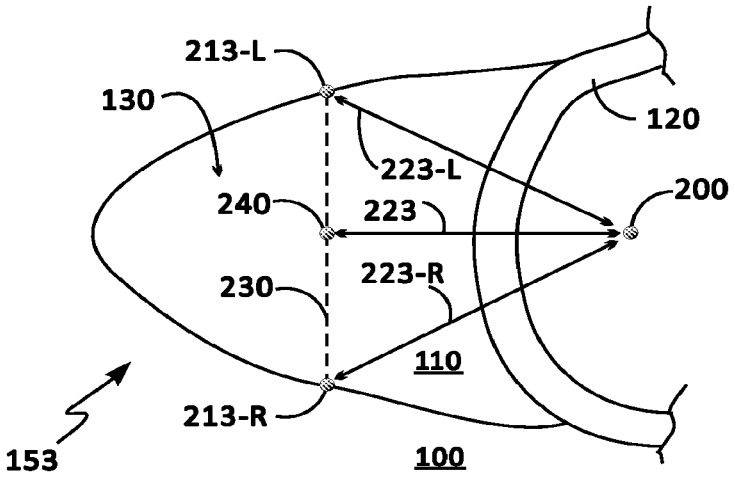
FIG. 2C is a drawing of the outline of the seat and part of the belt of the child carrier in the third coupling position of FIG. 1B.

FIG. 2C is a drawing of the outline of the seat 110 and part of the belt 120 of the child carrier 100 in the third coupling position 153 of FIG. 1B. Corresponding to FIG. 1B, in FIG. 2C the left coupler 125-L, which is not shown in FIG. 2C, is located on the seat 110 at a third left coupling location 213-L which is at a third left distance 223-L from the reference point 200, and the right coupler 125-R, which is also not shown in FIG. 2C, is located on the seat 110 at a third right coupling location 213-R which is at a third right distance 223-R from the reference point 200. Collectively the third left coupling location 213-L and the third right coupling location 213-R are referred to herein as the third coupling location 213. The third coupling location 213 is not shown in the drawings but could be represented by the point 240 on FIG. 2C. Also collectively the third left distance 223-L and the third right distance 223-R are referred to herein and shown as a representative third distance 223. The third distance 223 could be measured, for example, from the point 240 located on a line segment 230 between the third left coupling location 213-L and the third right coupling location 213-R, which could be, for example, the mid-point of that line segment 230, to the reference point 200.

Figure 2D:
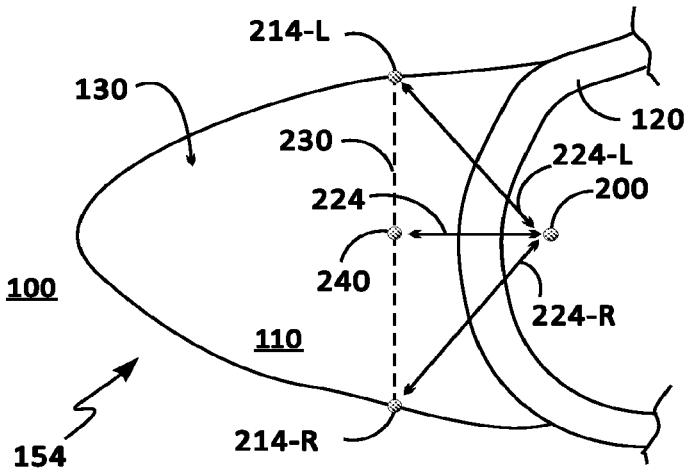
FIG. 2D is a drawing of the outline of the seat and part of the belt of the child carrier in the fourth coupling position of FIG. 1C.

FIG. 2D is a drawing of the outline of the seat 110 and part of the belt 120 of the child carrier 100 in the fourth coupling position 154 of FIG. 1C. Corresponding to FIG. 1C, in FIG. 2D the left coupler 125-L, which is not shown in FIG. 2D, is located on the seat 110 at a fourth left coupling location 214-L which is at a fourth left distance 224-L from the reference point 200, and the right coupler 125-R, which is also not shown in FIG. 2D, is located on the seat 110 at a fourth right coupling location 214-R which is at a fourth right distance 224-R from the reference point 200. Collectively the fourth left coupling location 214-L and the fourth right coupling location 214-R are referred to herein as the fourth coupling location 214. The fourth coupling location 214 is not shown in the drawings but could be represented by the point 240 on FIG. 2D. Also collectively the fourth left distance 224-L and the fourth right distance 224-R are referred to herein and shown as a representative fourth distance 224. The fourth distance 224 could be measured, for example, from the point 240 located on a line segment 230 between the fourth left coupling location 214-L and the fourth right coupling location 214-R, which could be, for example, the mid-point of that line segment 230, to the reference point 200.

Figure 2E:
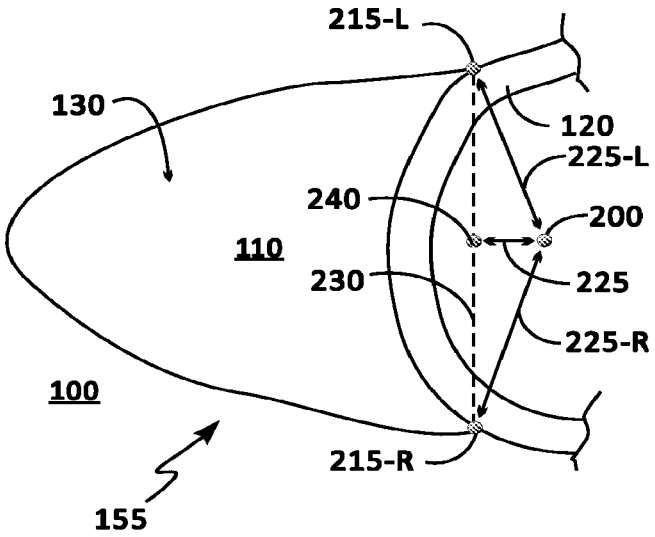
FIG. 2E is a drawing of the outline of the seat and part of the belt of the child carrier in the fifth coupling position of FIG. 1D.

FIG. 2E is a drawing of the outline of the seat 110 and part of the belt 120 of the child carrier 100 in the fifth coupling position 155 of FIG. 1D. Corresponding to FIG. 1D, in FIG. 2E the left coupler 125-L, which is not shown in FIG. 2E, is located on the seat 110 at a fifth left coupling location 215-L which is at a fifth left distance 225-L from the reference point 200, and the right coupler 125-R, which is also not shown in FIG. 2E, is located on the seat 110 at a fifth right coupling location 215-R which is at a fifth right distance 225-R from the reference point 200. Collectively the fifth left coupling location 215-L and the fifth right coupling location 215-R are referred to herein as the fifth coupling location 215. The fifth coupling location 215 is not shown in the drawings but could be represented by the point 240 on FIG. 2E. Also collectively the fifth left distance 225-L and the fifth right distance 225-R are referred to herein and shown as a representative fifth distance 225. The fifth distance 225 could be measured, for example, from the point 240 located on the line segment 230 between the fifth left coupling location 215-L and the fifth right coupling location 215-R, which could be, for example, the mid-point of that line segment 230, to the reference point 200.

A general placement of the left coupler 125-L is referred to herein as being located at a left coupling location 210-L which is a left distance 220-L from the reference point 200, and a general placement of the right coupler 125-R is referred to herein as being located at a right coupling location 210-R which is a right distance 220-R from the reference point 200. Collectively the left coupling location 210-L and the right coupling location 210-R are referred to as the coupling location 210 or the coupling locations 210, and collectively the left distance 220-L and the right distance 220-R are referred to as the distance 220.

While not specifically shown in any of the figures, the left coupling location 210-L refers in general to the first left coupling location 211-L, the second left coupling location 212-L, the third left coupling location 213-L, the fourth left coupling location 214-L, the fifth left coupling location 215-L, and/or any other similarly associated location; while not specifically shown in any of the figures, right coupling location 210-R refers in general to the first right coupling location 211-R, the second right coupling location 212-R, the third right coupling location 213-R, the fourth right coupling location 214-R, the fifth right coupling location 215-R, and/or any other similarly associated location; while not specifically shown in any of the figures, left distance 220-L refers in general to the first left distance 221-L, the second left distance 222-L, the third left distance 223-L, the fourth left distance 224-L, the fifth left distance 225-L, and/or any other similarly associated distance; and while not specifically shown in any of the figures, the right distance 220-R refers in general to the first right distance 221-R, the second right distance 222-R, the third right distance 223-R, the fourth right distance 224-R, the fifth right distance 225-R, and/or any other associated distance.

Figure 3A:
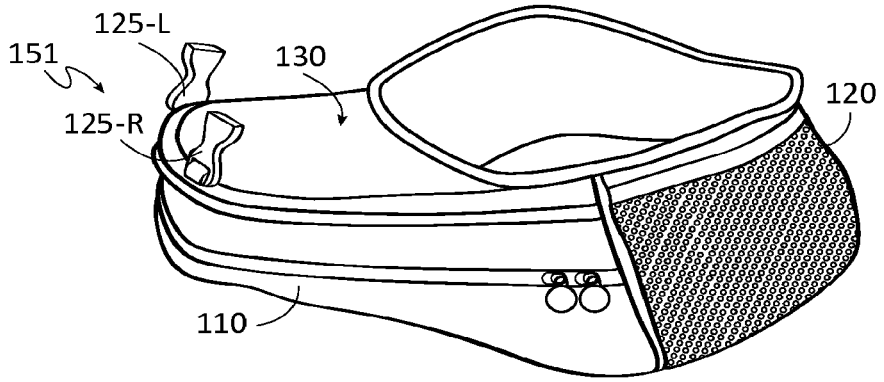
FIG. 3A is another drawing of the seat and the belt of the child carrier in the first coupling position of FIGS. 1A and 2A.

FIG. 3A is another drawing of the seat 110 and the belt 120 of the child carrier 100 in the first coupling position 151 of FIGS. 1A and 2A. FIG. 3A shows the one or more couplers 125 for coupling the torso support 115 to the seat 110 in the first coupling position 151. In FIG. 3A the one or more couplers 125 comprise the left coupler 125-L and the right coupler 125-R. As in FIG. 2A the left coupler 125-L is located on the seat 110 at the first left coupling location 211-L which is positioned at the first left distance 221-L from the selected reference point 200 (See FIG. 2A), and the right coupler 125-R is located on the seat 110 at the first right coupling location 211-R which is positioned at the first right distance 221-R from the reference point 200 (See FIG. 2A). And as in the discussion of FIG. 2A, collectively the placement in FIG. 3A of the left and right couplers 125-L, 125-R is referred to as the first coupling location 211 located at the first distance 221 from the reference point 200.

Figure 3B:
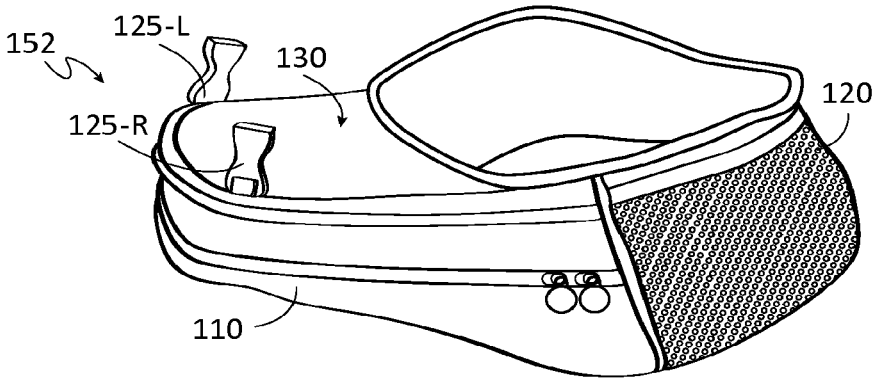
FIG. 3B is another drawing of the seat and the belt of the child carrier in the second coupling position of FIG. 2B and intermediate to that of FIGS. 1A and 1B.

FIG. 3B is another drawing of the seat 110 and the belt 120 of the child carrier 100 in the second coupling position 152 of FIG. 2B and intermediate to that of FIGS. 1A and 1B. FIG. 3B shows the one or more couplers 125 for coupling the torso support 115 to the seat 110 in the second coupling position 152. In FIG. 3B the one or more couplers 125 comprise the left coupler 125-L and the right coupler 125-R. As in FIG. 2B the left coupler 125-L is located on the seat 110 at the second left coupling location 212-L which is positioned at the second left distance 222-L from the selected reference point 200 (See FIG. 2B), and the right coupler 125-R is located on the seat 110 at the second right coupling location 212-R which is positioned at the second right distance 222-R from the reference point 200 (See FIG. 2B). As in the discussion of FIG. 2B, collectively the placement in FIG. 3B of the left and right couplers 125-L, 125-R is referred to as the second coupling location 212 located at the second distance 222 from the reference point 200.

Figure 3C:
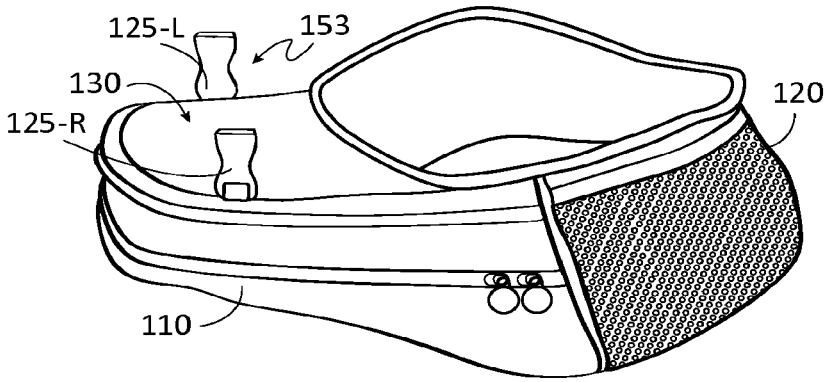
FIG. 3C is another drawing of the seat and the belt of the child carrier in the third coupling position of FIGS. 1B and 2C.

FIG. 3C is another drawing of the seat 110 and the belt 120 of the child carrier 100 in the third coupling position 153 of FIGS. 1B and 2C. FIG. 3C shows the one or more couplers 125 for coupling the torso support 115 to the seat 110 in the third coupling position 153. In FIG. 3C the one or more couplers 125 comprise the left coupler 125-L and the right coupler 125-R. As in FIG. 2C the left coupler 125-L is located on the seat 110 at the third left coupling location 213-L which is positioned at the third left distance 223-L from the selected reference point 200 (see FIG. 2C), and the right coupler 125-R is located on the seat 110 at the third right coupling location 213-R which is positioned at the third right distance 223-R from the reference point 200 (see FIG. 2C). As in the discussion of FIG. 2C, collectively the placement in FIG. 3C of the left and right couplers 125-L, 125-R is referred to as the third coupling location 213 located at the third distance 223 from the reference point 200.

Figure 3D:
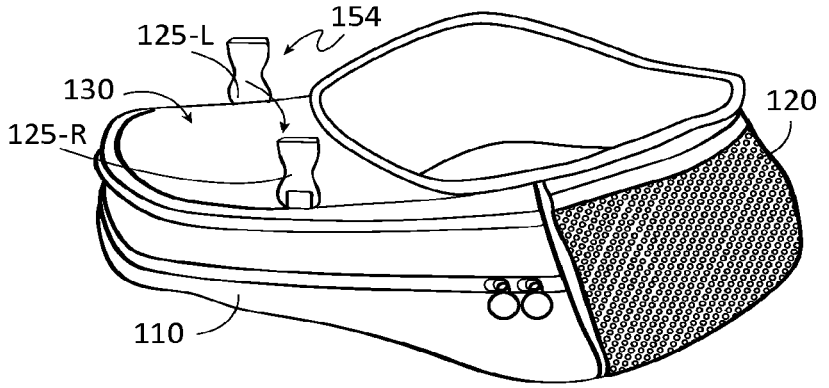
FIG. 3D is another drawing of the seat and the belt of the child carrier in the fourth coupling position of FIGS. 1C and 2D.

FIG. 3D is another drawing of the seat 110 and the belt 120 of the child carrier 100 in the fourth coupling position 154 of FIGS. 1C and 2D. FIG. 3D shows the one or more couplers 125 for coupling the torso support 115 to the seat 110 in the fourth coupling position 154. In FIG. 3D the one or more couplers 125 comprise the left coupler 125-L and the right coupler 125-R. As in FIG. 2D the left coupler 125-L is located on the seat 110 at the fourth left coupling location 214-L which is positioned at the fourth left distance 224-L from the selected reference point 200 (see FIG. 2D), and the right coupler 125-R is located on the seat 110 at the fourth right coupling location 214-R which is positioned at the fourth right distance 224-R from the reference point 200 (see FIG. 2D). As in the discussion of FIG. 2D, collectively the placement in FIG. 3D of the left and right couplers 125-L, 125-R is referred to as the fourth coupling location 214 located at the fourth distance 224 from the reference point 200.

Figure 3E:
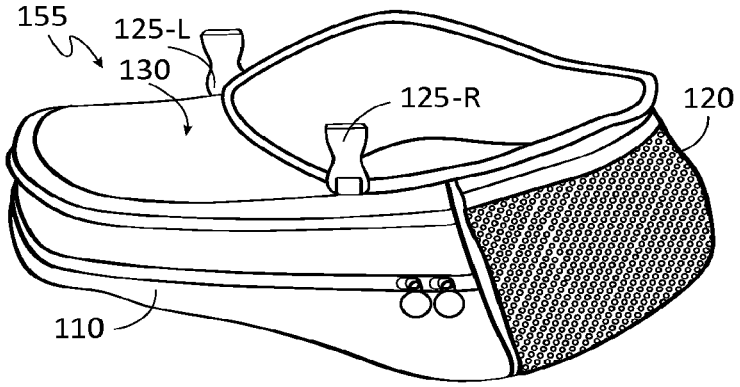
FIG. 3E is another drawing of the seat and the belt of the child carrier in the fifth coupling position of FIGS. 1D and 2E.

FIG. 3E is another drawing of the seat 110 and the belt 120 of the child carrier 100 in the fifth coupling position 155 of FIGS. 1D and 2E. FIG. 3E shows the one or more couplers 125 for coupling the torso support 115 to the seat 110 in the fifth coupling position 155. In FIG. 3E the one or more couplers 125 comprise the left coupler 125-L and the right coupler 125-R. As in FIG. 2E the left coupler 125-L is located on the seat 110 at the fifth left coupling location 215-L which is positioned at the fifth left distance 225-L from the selected reference point 200 (see FIG. 2E), and the right coupler 125-R is located on the seat 110 at the fifth right coupling location 215-R which is positioned at the fifth right distance 225-R from the reference point 200 (see FIG. 2E). As in the discussion of FIG. 2E, collectively the placement in FIG. 3E of the left and right couplers 125-L, 125-R is referred to as the fifth coupling location 215 located at the fifth distance 225 from the reference point 200.

Figure 4A:
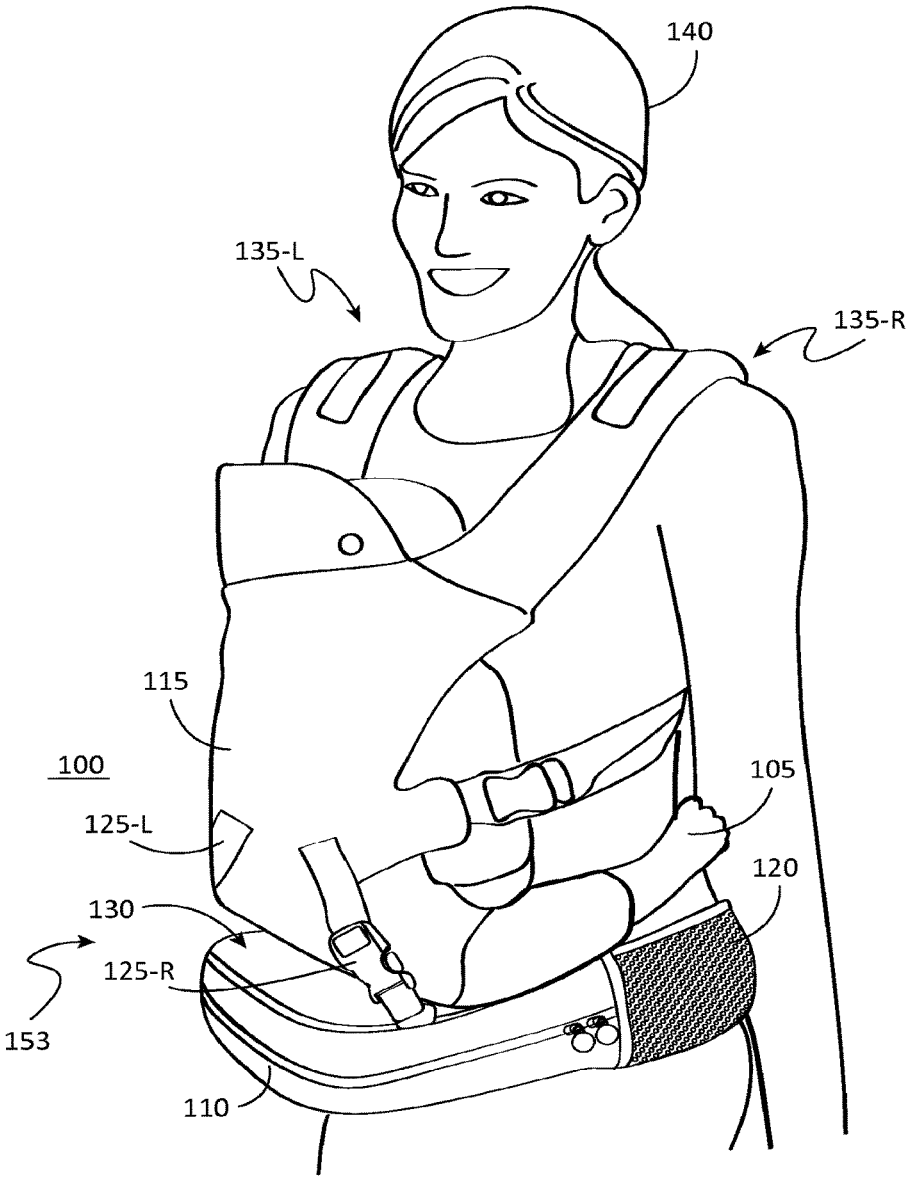
FIG. 4A is a drawing of the child carrier of FIG. 1A with the child carried on the front of the transporting individual and with the child facing toward the transporting individual.

FIG. 4A is a drawing of the child carrier 100 of FIG. 1A with the child 105 carried on the front of the transporting individual 140 and with the child 105 facing toward the transporting individual 140.

Figure 4B:
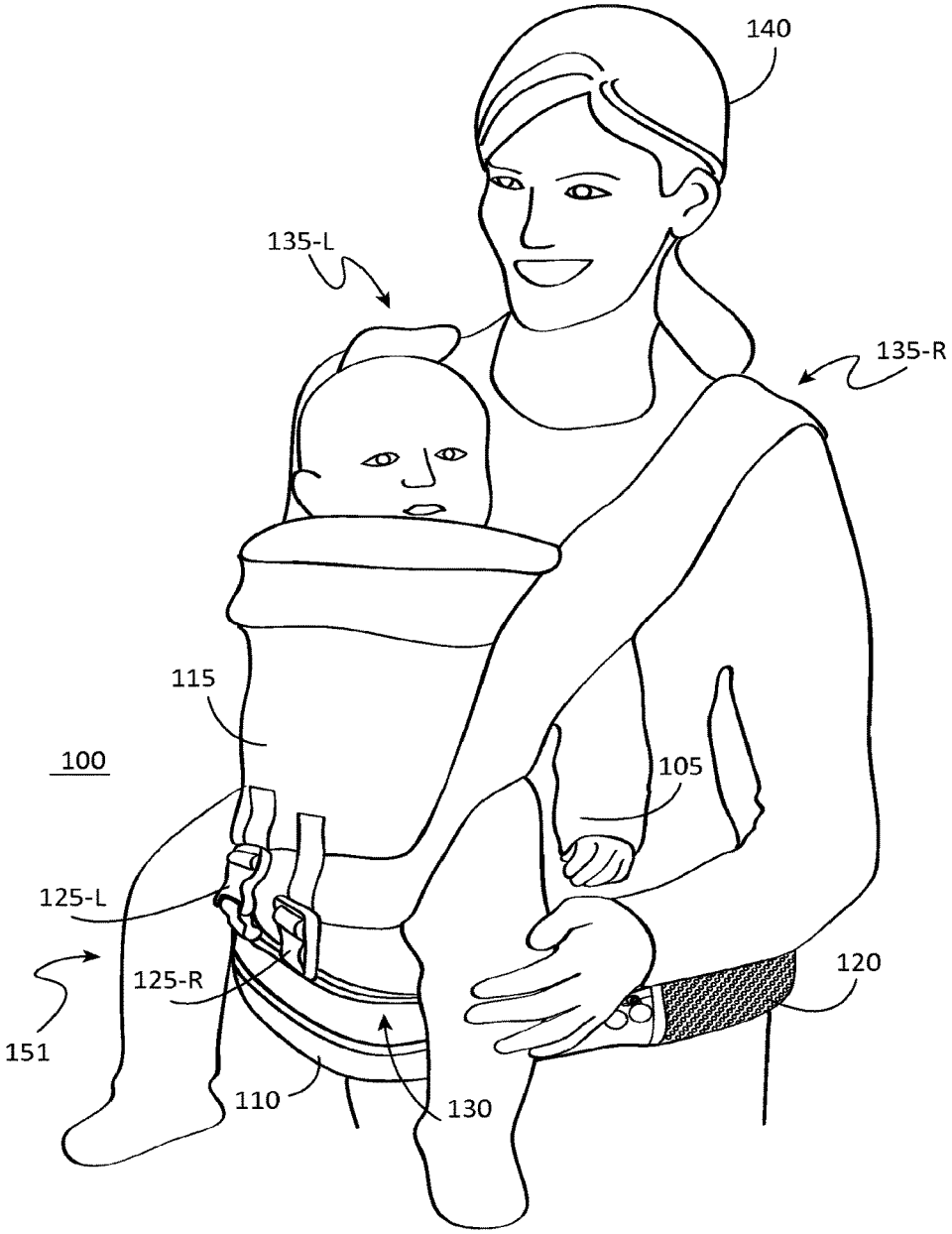
FIG. 4B is a drawing of the child carrier of FIG. 1A with the child carried on the front of the transporting individual and with the child facing away from the transporting individual.

FIG. 4B is a drawing of the child carrier 100 of FIG. 1A with the child 105 carried on the front of the transporting individual 140 and with the child 105 facing away from the transporting individual 140.

Figure 5A:
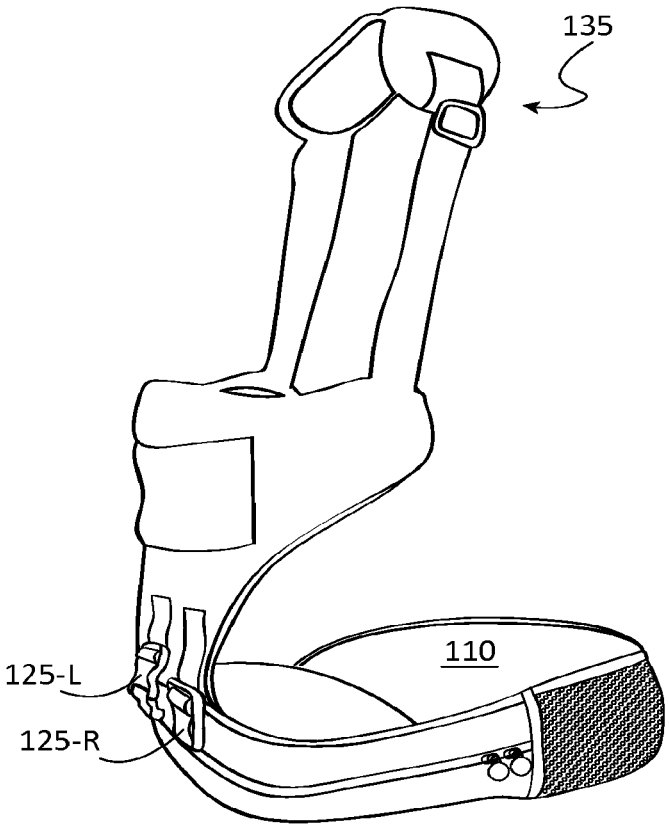
FIG. 5A is a drawing of a child carrier having a single shoulder strap as described in various representative embodiments.

FIG. 5A is a drawing of a child carrier 100 having a single shoulder strap 135 as described in various representative embodiments. The shoulder strap 135 could comprise one or more smaller straps and/or other elements, as well as coupling devices configured for coupling to the torso support 115 and/or to the seat 110 and/or the belt 120 as well as to each other and/or to each other via a connecting coupling. The child carrier 100 of FIG. 5A could be used for carrying the child sideways on the hip of the transporting individual 140.

Figure 5B:
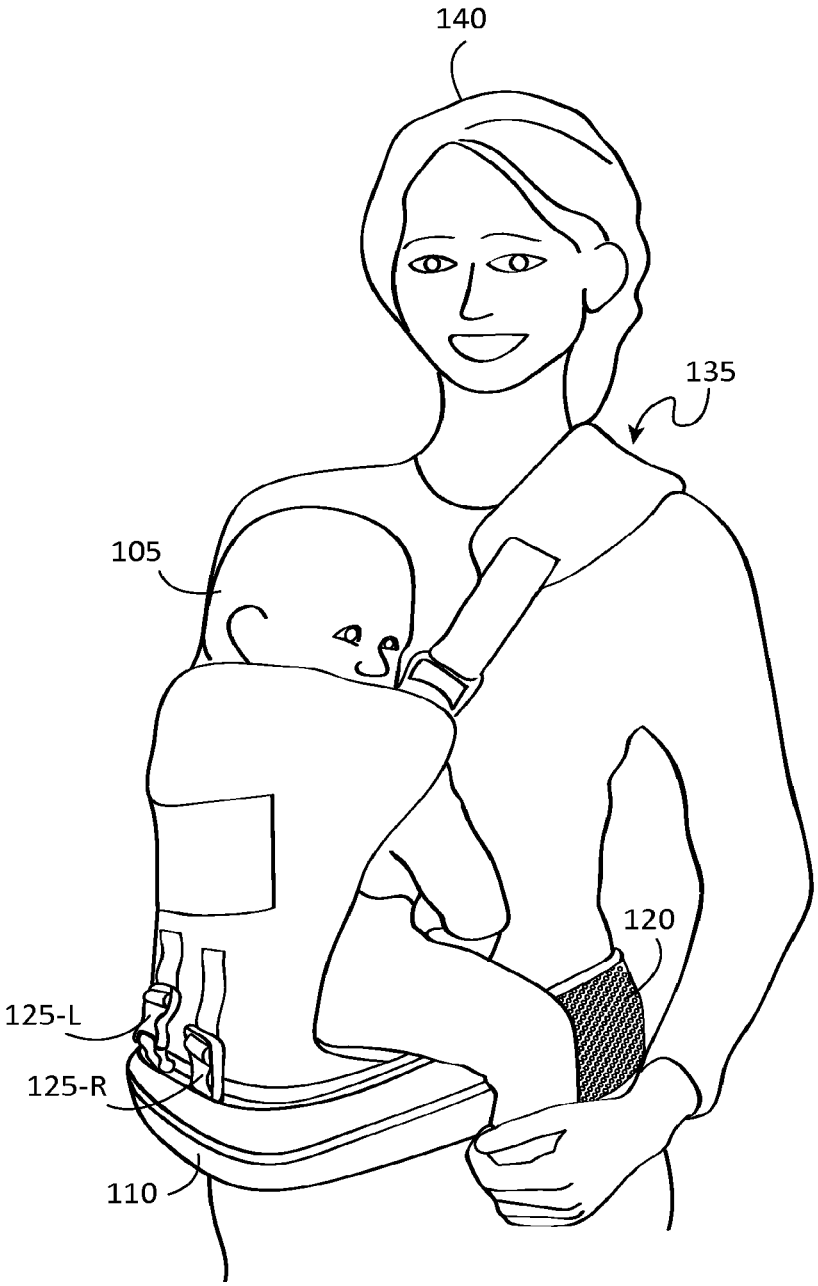
FIG. 5B is another drawing of the child carrier of FIG. 5A.

FIG. 5B is another drawing of the child carrier 100 of FIG. 5A. In FIG. 5B the child 105 is carried sideways on the hip of the transporting individual 140 with the child 105 facing toward the transporting individual 140.

Figure 6A:
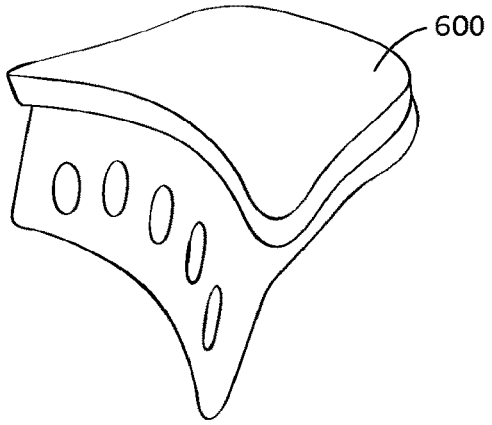
FIG. 6A is a drawing of a seat insert as described in various representative embodiments.

FIG. 6A is a drawing of a seat insert 600 as described in various representative embodiments.

Figure 6B:
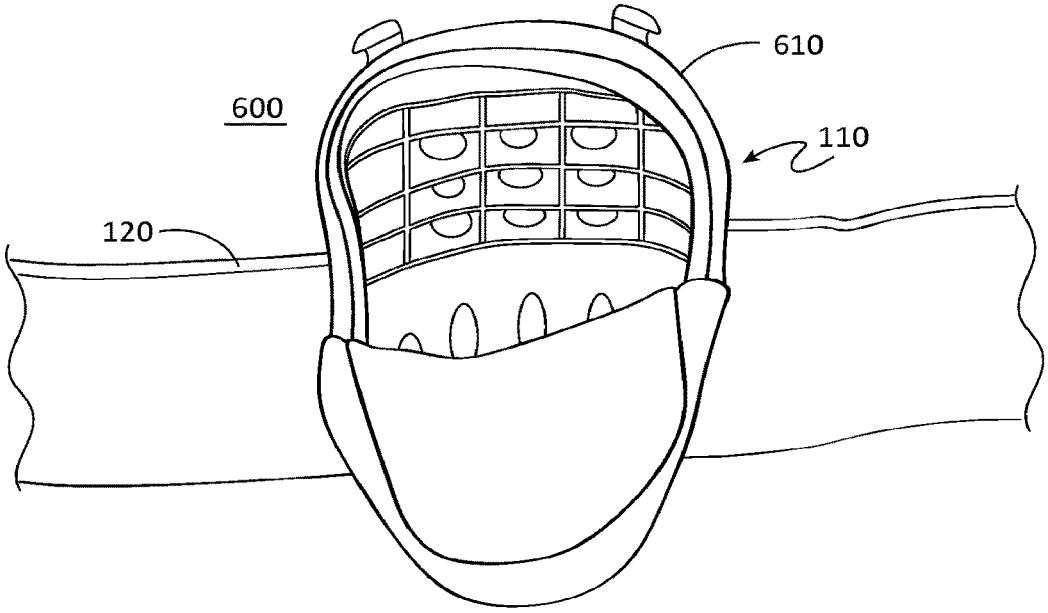
FIG. 6B is a drawing of the seat insert of FIG. 6A placed in a seat cover of a seat of a child carrier as described in various representative embodiments.

FIG. 6B is a drawing of the seat insert 600 of FIG. 6A placed in a seat cover 610 of a seat 110 of the child carrier 100 as described in various representative embodiments. In representative embodiments, the seat 110 of the child carrier 100 could alternatively comprise a seat cover 610, which is also referred to herein as an insert cover 610 and as a cover 610, and a seat insert 600, which is also referred to as an insert 600 herein. The seat insert 600 could be sufficiently rigid and placed in the cover 610 so as to enable supporting the child 105 when the child 105 is placed in the child carrier 100.

Figure 7A:
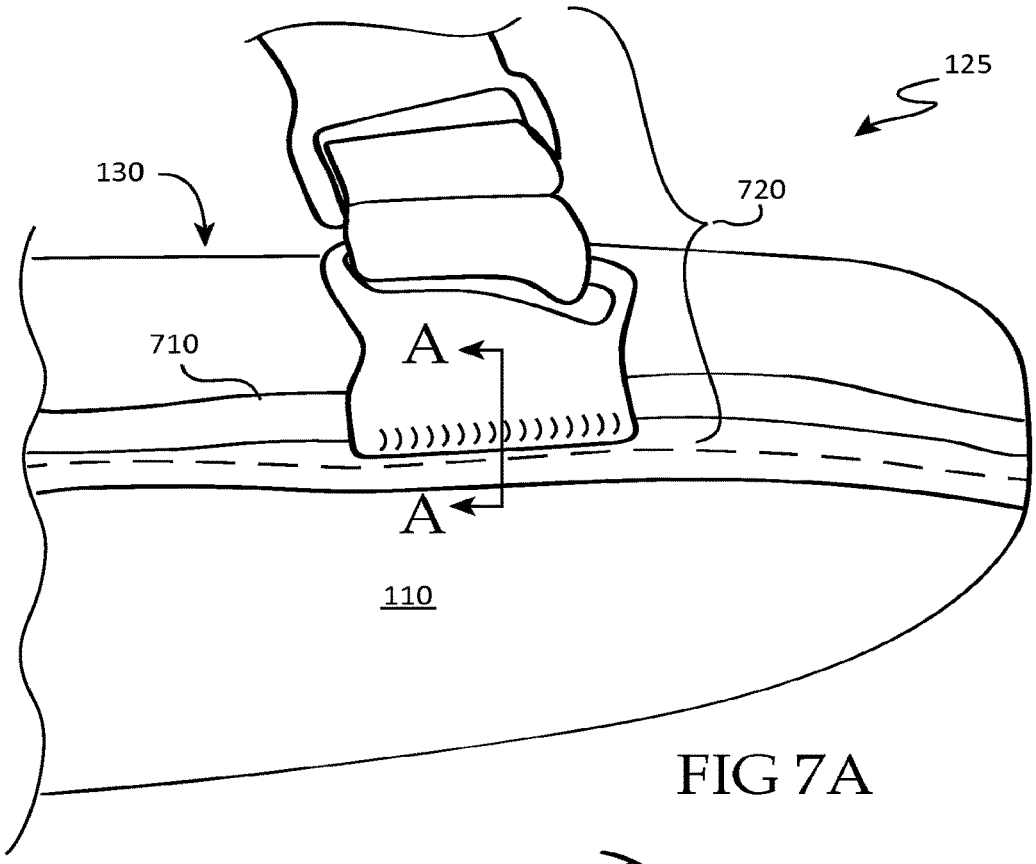
FIG. 7A is a drawing of a coupler attached to the seat of the child carrier as described in various representative embodiments.
Figure 7B:
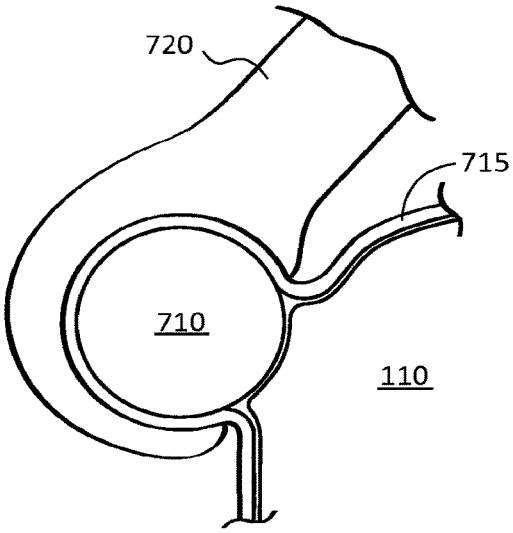
FIG. 7B is a drawing of a cross-sectional view of the coupler in the direction A-A of FIG. 7A.

FIG. 7A is a drawing of a coupler 125 attached to the seat 110 of the child carrier 100 as described in various representative embodiments. FIG. 7B is a drawing of a cross-sectional view of the coupler 125 in the direction A-A of FIG. 7A. In FIGS. 7A-7B the coupler 125 comprises a track 710 and a clasp 720. The track 710 could be fixedly coupled to the seat 110, and the clasp 720 could be coupled to the torso support 115. The location of the clasp 720 along the length of the track 710 could be adjusted continuously enabling thereby the continuous adjustment of the depth of the seat 110 available to the child 105 for support. In the representative embodiment of FIGS. 7A-7B, the track 710 is attached to the seat 110. This attachment could be effected by overlaying the track 710 and at least part of the seat 110 with a layer 715 of material which layer 715 is bonded subsequently to the seat 110 along the length of the track 710 by sewing the material to the seat 110, by use of an adhesive or by any other appropriate means. The clasp 720 securely fastens around the track 710 such that the clasp 720 can be moved from one coupling location 210 to another along the length of the track 710. The clasp 720 could comprise any of various components which enable attachment to the torso support 115.

The track 710 in FIGS. 7A-7B could be fabricated using a variety of materials including but not limited to a plastic tube and a metal wire or cable. Any of these materials could be glued or otherwise bonded to the seat 110 or alternatively covered by a fabric which is sown sew or otherwise bonded to the seat. The clasp 720 could likewise be fabricated using a variety of materials including but not limited to plastic and metal. The clasp 720 could be glued or otherwise attached to the torso support 115. In other embodiments, an optional mechanism to lock the clasp 720 to the track 710 at one or more locations could be added. Also the clasp 720 could be configured to grasp the track 710 in other configurations that could provide more resistance to movement of the clasp 720 relative to the track 710.

In various representative embodiments, the coupling location 210 could be changed from one location to another either in discreet steps or by a continuous adjustment within a selected range of the distance 220 between the coupling location 210 and the reference point 200. The selected range for the coupling locations 210 of the couplers 125 could be set to include any accessible and useful coupling locations 210. In representative examples, the selected range could extend from the first coupling location 211 to the fifth coupling location 215, from the first coupling location 211 to the third coupling location 213, from the second coupling location 212 to the fourth coupling location 214 or between any other appropriate selected coupling locations.

In a representative embodiment, a carrier 100 for transporting a child 105 by a transporting individual 140 is disclosed. The carrier 100 comprises a belt 120, a seat 110, a torso support 115, and one or more couplers 125. The belt 120 is configured for securing about the waste and/or hips of the transporting individual 140; the seat 110 is coupled to the belt 120, is configured for at least partially supporting the child 105 if the child 105 is seated in the carrier 100, and has a surface 130 configured for at least partially supporting at least part of the posterior of the child 105; the torso support 115 is coupled to the seat 110 by one or more couplers 125 and is configured for supporting at least part of the torso of the child 105; and the one or more couplers 125 are configured to enable the adjustment of a distance 220 between one or more coupling locations 210 for each of the one or more couplers 125 and a selected reference point 200.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

What is claimed is:

1. A child carrier, comprising:

a seat coupled with a belt, the belt forming a loop;

a torso support coupled to the seat via at least two couplers, each of the at least two couplers being attached to the torso support via a strap and movably attached at the seat, each of the at least two couplers configured to attach to the seat at respective first and second coupling positions, each of the at least two couplers attaching at one of the respective first and second coupling positions at a given time;

a track attached to the seat for interacting with each of the at least two couplers, each of the at least two couplers including a clasp slidably coupled to the track;

sliding movement of each at least two couplers along the track causing a distance to change, the distance defined by a reference point within the loop and a point on a line intersecting each of the at least two couplers, the distance at the second coupling position being longer than the distance at the respective first coupling position;

wherein, the first coupling position is configured to allow the posterior of a child in the carrier to be supported by only the torso support.

2. The child carrier of claim 1, the track being fixedly attached along a perimeter surface of the seat.

3. The child carrier of claim 1, further comprising a layer of material located between each at least one coupler and the track.

4. The child carrier of claim 1, each of the at least one coupler being lockable at one or more locations with respect to the seat.

5. The child carrier of claim 1, each of the at least one coupler being moveably attached in a manner providing discrete adjustment locations.

6. The child carrier of claim 1, each of the at least one coupler being slideably attached in a manner providing continuous adjustment locations.

7. The child carrier of claim 1, the seat including a removable seat insert within a seat cover, the seat insert sufficiently rigid so as to enable supporting of a child placed in the child carrier.

8. The child carrier of claim 7, the removable seat insert including a first surface adjacent a top surface of a seat insert, and a second surface at an angle thereto adjacent the belt.

9. The child carrier of claim 1, further including a shoulder strap.

10. The child carrier of claim 8, the shoulder strap including two shoulder straps.

11. The child carrier of claim 8, the shoulder strap coupled to the torso support.

12. The child carrier of claim 10, the shoulder strap coupled to the torso support at least at two locations.

13. The child carrier of claim 8, the shoulder strap coupled to one or both of the seat, and the belt.

14. The child carrier of claim 1, each of the at least two couplers being moveably attached to the seat at a respective third coupling position, the distance at the third coupling position being longer than the distance at the respective second coupling position.

15. The child carrier of claim 14, each of the at least two couplers being moveably attached to the seat at a respective fourth coupling position, the distance at the fourth coupling position being longer than the distance at the respective third coupling position.

16. The child carrier of claim 15, each of the at least two couplers being moveably attached to the seat at a respective fifth coupling position, the distance at the fifth coupling position being longer than the distance at the respective fourth coupling position.

17. The child carrier of claim 1, each of the at least one coupler coupled to the track via at least partially surrounding the track.

* * * * *